United States Patent [19]

Adlerteg

[11] 4,311,353

[45] Jan. 19, 1982

[54] SWITCHGEAR BUS AND CONNECTION STRUCTURE

[75] Inventor: Bo Adlerteg, Vesteras, Sweden

[73] Assignee: Asea AB, Vesterås, Sweden

[21] Appl. No.: 128,825

[22] Filed: Mar. 10, 1980

[30] Foreign Application Priority Data

Mar. 15, 1979 [SE] Sweden ..... 7902316

[51] Int. Cl.[3] ..... H01R 13/20

[52] U.S. Cl. ..... 339/22 R; 339/32 R

[58] Field of Search ..... 339/21, 22 R, 22 B, 339/32, 33, 31

[56] References Cited

U.S. PATENT DOCUMENTS

| | | | |
|---|---|---|---|
| 2,297,374 | 9/1942 | Tingle | 339/33 |
| 2,783,444 | 2/1957 | Tidd | 339/22 R |
| 3,858,156 | 12/1974 | Zarro | 339/32 |
| 3,933,403 | 1/1976 | Rubesamen et al. | 339/22 R |
| 4,173,382 | 11/1979 | Booty | 339/22 B |

*Primary Examiner*—Joseph H. McGlynn
*Assistant Examiner*—Frank H. McKenzie, Jr.
*Attorney, Agent, or Firm*—Watson, Cole, Grindle & Watson

[57] ABSTRACT

For use in a low-voltage switchgear there is provided the combination of a busbar and at least one electrical coupling device for screw connection or plug-in connection to the busbar. The busbar is in the form of a hollow channel section bar, the cross-section of which comprises two outer branches projecting from the same side of a base. Each outer branch has a thickened edge portion along its edge remote from the base, which is provided with an open groove, the bottom of which constitutes a contact surface for said screw connection coupling devices. In its hollow interior, the busbar has contact surfaces for said plug-in coupling devices. Surfaces of the busbar other than said contact surfaces have an electrically insulating coating.

11 Claims, 8 Drawing Figures

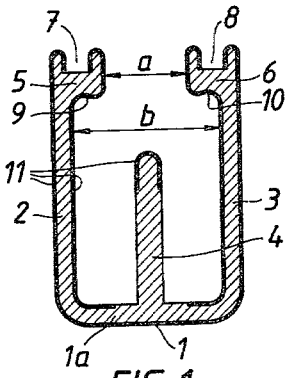
FIG. 1
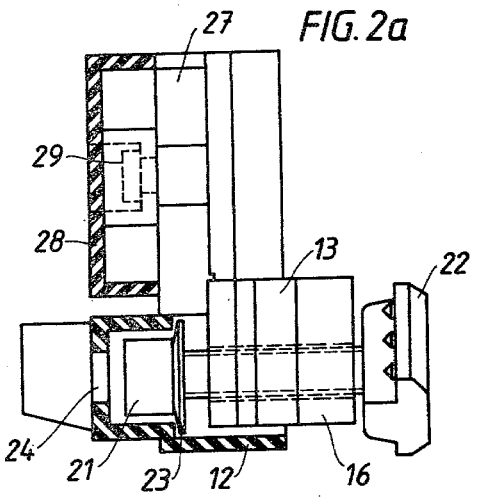
FIG. 2a
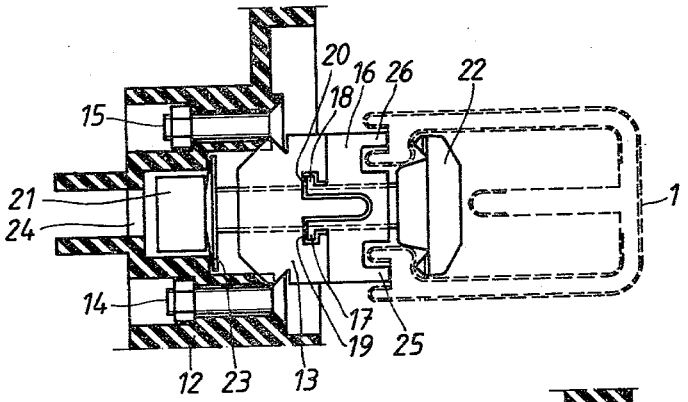
FIG. 2b
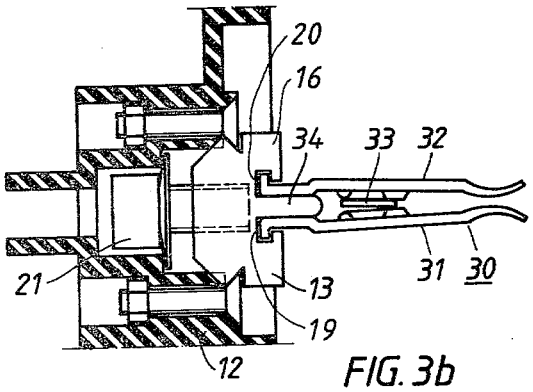
FIG. 3b
FIG. 3a
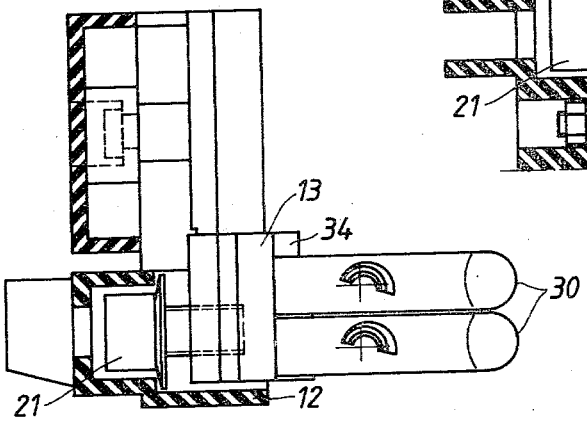

FIG. 4a
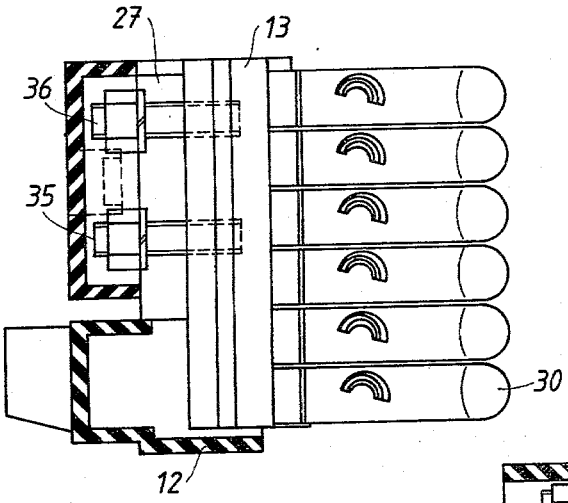
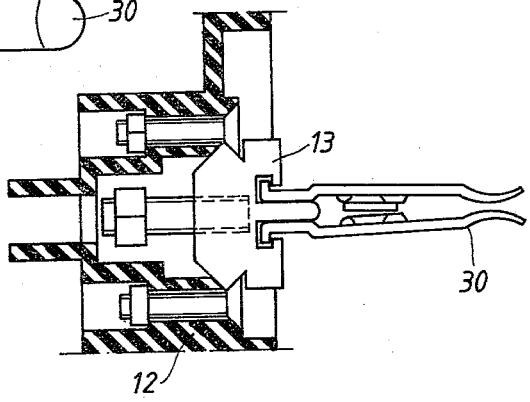
FIG. 4b
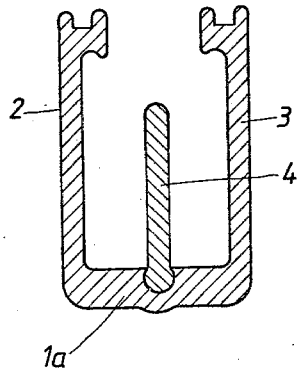
FIG. 5

SWITCHGEAR BUS AND CONNECTION STRUCTURE

TECHNICAL FIELD

This invention is concerned with the combination of a busbar and at least one electrical coupling device for establishing electrical contact with the busbar, which combination is intended for use in electrical switchgear, in particular, but not exclusively, cubicle-enclosed switchgear for operating voltages of up to 1000 volts.

BACKGROUND ART

To improve the safety of low-voltage switchgear, various attempts have been made to provide protection against personnel coming into contact with live components. Usually, this has been accomplished by the use of electrically insulating screens, certain of which, at least in switchgear having withdrawable apparatus groups, have to be movable. Thus, stationary insulating screens are often arranged in front of the busbars, said screens having apertures for the connection of electrical coupling devices to, and their disconnection from, the busbars, which apertures are automatically covered by movable screens when an apparatus group is withdrawn from the switchgear cubicle. The provision of movable screens of this kind is complicated and expensive. In addition, the screens usually render it impossible to effect a replacement, under voltage, of one apparatus group by another apparatus group of a different size, since the spacing apart of the connection apertures provided in the screens is not usually suitable for the replacement group.

It is also known previously to use semi-protected busbars in low-voltage switchgear. (By the term "semi-protected busbar" is meant a busbar in which it is not possible to touch a live part of the bar with a standardized test finger positioned in any conceivable manner.) However, the design of these busbars has been such that it has only been possible to carry out connections to the busbar using special screw connection coupling devices.

The present invention aims to provide a combination of a semi-protected busbar and at least one electrical coupling device, in which said at least one coupling device may be of the screw connection type and/or the plug-in type as desired by the user.

DISCLOSURE OF THE INVENTION

According to the invention, in the combination of a semi-protected busbar, as hereinbefore defined, and at least one electrical coupling device for establishing electrical contact with the busbar, said at least one coupling device being a screw connection coupling device and/or a plug-in coupling device, said busbar is in the form of an elongated bar of channel section comprising a base and two spaced-apart outer branches projecting from the same side of the base, each of said outer branches having a thickened edge portion along its edge remote from the base, each of said thickened edge portions having an outwardly-facing open slot extending therealong with a bottom constituting a first contact surface for a screw connection coupling device, and at least one internal surface of the busbar constituting a second contact surface for a plug-in coupling device, and surfaces of said busbar other than said first and second contact surfaces are provided with an electrically insulating coating.

In a combination in accordance with the invention, the same busbar and to a large extent the same connection components may be used irrespective of whether the user wishes to employ screw connection coupling devices and/or plug-in coupling devices, which involves considerable advantages from the point of view of production. Furthermore, the use of expensive screens for the protection of personnel when the combination is in use with electrical switchgear is dispensed with. Since connections may be made freely at any place along the busbars, it is also possible to replace apparatus groups of mutually different sizes under voltage. In addition, the invention makes it possible to mount both fixed and withdrawable apparatus groups in one and the same switchgear cubicle.

BRIEF DESCRIPTION OF DRAWINGS

The invention will now be described, by way of example, with reference to the accompanying drawings, in which FIG. 1 is a cross-sectional view of a busbar intended for use in a low-voltage switchgear, FIG. 2*a* is a sectional view of a coupling device intended to be connected by screwing, to the busbar of FIG. 1, the coupling device being seen from the side perpendicular to the busbar, FIG. 2*b* is a sectional view of the coupling device of FIG. 2*a*, seen in the longitudinal direction of the busbar, FIGS. 3*a* and 3*b* are views similar to FIGS. 2*a* and 2*b*, respectively, of a coupling device of the plug-in type intended for connection of apparatus groups for operating currents of up to about 100 A, FIGS. 4*a* and 4*b* are views similar to FIGS. 3*a* and 3*b*, respectively, of a coupling device for higher operating currents, and FIG. 5 is a cross-sectional view of a busbar composed of two parts.

DESCRIPTION OF PREFERRED EMBODIMENTS

The busbar 1 shown in FIG. 1 is primarily intended to be used in switchgear for low voltage, for example in cubicle-enclosed switchgear, in which it would suitably be used as a vertical busbar mounted at the rear of the apparatus cubicle of the switchgear and connected to a horizontal main busbar positioned, for example, at the top of the cubicle.

The busbar 1 shown in FIG. 1 is manufactured by extrusion and has a substantially E-shaped cross-section, the two outer branches 2, 3, protruding from the base portion 1*a*, being longer than the middle branch 4. The busbar is intended to be installed in a switchgear cubicle in such a way that it has its opening facing the cubicle door. The forward edge portion 5, 6 of each outer branch 2, 3 is thicker than the remainder of the branch, with the result that the width of the opening of the profile (the distance a) is smaller than the internal distance between the outer branches (the distance b).

Each of the thicker edge portions 5, 6 has a respective longitudinal, forwardly-facing, open slot 7, 8, the bottom of which constitutes the contact surface for screw connection coupling devices connectible to the busbar. The rearwardly-facing sides of the edge portions 5, 6 constitute respective shoulder surfaces 9, 10 for the clamping devices of the screw connection coupling devices. These shoulder surfaces may with advantage be slightly concave.

On the greater part of its external and internal surfaces, the busbar 1 is provided with an electrically insulating coating 11, only the bottom surfaces of the slots 7, 8 and part of the side surfaces of the middle branch 4 being uninsulated.

FIGS. 2*a* and 2*b* show in cross-section one pole of a three-pole coupling device of the screw connection type for connecting an apparatus group (not shown) to the busbar 1. The coupling device has a base 12 of electrically insulating material, and a connection part 13 attached to the base 12 by means of two screws 14, 15. The connection part 13 comprises a piece of an extruded profile bar of, for example, aluminium. A contact element 16, which is also in the form of an extruded profile, has two L-shaped projections 17, 18 engaged in slots 19, 20, in the connection part 13, these slots being shaped to suit the projections 17, 18. The parts 13 and 16 are provided with a through-hole for a clamping screw 21, which is threaded in a nut 22 which is insertable into the hollow interior of the busbar 1 and is pressed against the shoulder surfaces 9, 10 of the busbar 1 when the clamping screw 21 is tightened. The coupling device is intended for operating currents of up to about 100 A, and the connection to the apparatus group of the branch in question is intended to be made with, for example, a 35 $mm^2$ cable (not shown) with a cable shoe, which is clamped between a plate 23 and the connection part 13 with the aid of the clamping screw 21. The tightening of the clamping screw 21 is effected with a screw driver, which may be inserted through a hole 24 in the base 12. The contact element 16 of the coupling device is provided with protruding wall portions 25, 26, which, when the clamping screw 21 is tightened, are pressed against the forwardly-facing contact surfaces of the busbar 1 in the slots 7, 8. The cable is led out through a slot 27 in the base 12, the slot 27 running parallel to the busbar 1. The slot 27 is covered by means of an electrically insulating cover 28, which is fixed to the base 12 by means of screws 29.

FIGS. 3*a* and 3*b* show a coupling device of the plug-in type having the same base 12 and connection part 13 as the coupling device shown in FIGS. 2*a* and 2*b*. This coupling device is also intended for operating currents of up to about 100 A, and connection to the apparatus group in question is performed by a cable (not shown) provided with a cable shoe, which is clamped against the connection part 13 by means of the clamping screw 21. The coupling device has two contact elements 30 arranged in parallel for current collection for the busbar 1. Each such contact element consists of two contact fingers 31, 32 which are held together by a draw spring 33.

The contact fingers 31, 32 have an L-shaped root end which fits into the slots 19, 20 of the connection part, a longitudinal contact strip 34 being arranged between said slots. The contact elements 30 are inserted into the slots 19, 20 from one end of the connection part 13 and are retained in the slots by a stop means provided, for example, by upsetting an end portion of the contact strip 34 and also by a wall portion in the base 12, which portion blocks the inlet opening of the slots 19, 20 when the connection part 13 with the contact elements 30 assembled thereon is mounted in the base.

The coupling device shown in FIGS. 3*a* and 3*b* is intended to be pushed onto the busbar 1, the two contact fingers 31, 32 of each contact element then being pressed through the action of the spring 33 against the uninsulated contact surfaces on either side of the middle branch 4 of the busbar 1, as well as against the side surfaces of the contact strip 34.

FIGS. 4*a* and 4*b* show a coupling device of the plug-in type, the design of which is in principle the same as that of the coupling device shown in FIGS. 3*a* and 3*b* but which is intended for a higher operating current, namely 630 A. In this coupling device, the connection part 13 is practically as long as the width of the base 12 and comprises six contact elements 30. The connection to the apparatus group of the branch is performed with a 6×30 mm bar (not shown) arranged in the slot 27 in the base 12 and clamped against the connection part 13 by two stud bolts 35, 36 provided with nuts and fixed to the connection part.

The busbar and the extruded profiles of the coupling devices described above are made of material having good electrical conductivity, preferably aluminium or copper or a combination of these materials. It would be possible, for example, to make the whole profiles of copper-clad aluminium or to make certain contact parts, such as the contact strip 34 of the connection part 13 and the middle branch 4 of the busbar 1, of copper and the other part of the profiles of aluminium. In the latter case the two profile parts are suitably joined to each other by pressing the copper part into a longitudinal slot in the aluminium part. A busbar of this design is shown in FIG. 5, where the base portion 1*a* and the outer branches 2, 3 of the busbar are of aluminium and the middle branch 4 is of copper.

The invention is not limited to the embodiments shown but may be realized in many other different ways. For example, the connection part 13 and the contact element 16 of the coupling device of FIGS. 2*a* and 2*b* need not be two separate parts, but may instead be made in one piece. Furthermore, the coupling devices need not have a base of their own, but may instead be mounted directly on an apparatus, for example a switch or a fuse base. It may then be suitable for the apparatus, during its manufacture, to be provided only with the connection part 13, the apparatus subsequently being supplemented, at the time of its installation in a switchgear, with either the contact element 16 for screw connection or the contact element 30 for plug-in connection, according to the need in each particular case.

What is claimed is:

1. The combination of a semi-protected busbar and an electrical coupling device for establishing electrical contact with the busbar, wherein said busbar is in the form of an elongated bar of channel section comprising a base and two spaced-apart outer branches projecting from the same side of the base, each of said outer branches having a thickened edge portion along its edge remote from the base, each of said thickened edge portions having an outwardly-facing open slot extending therealong with a bottom constituting a first contact surface for said coupling device of the screw connection type, and at least one internal surface of the busbar constituting a second contact surface for said coupling device of the plug-in type, and surfaces of said busbar other than said first and second contact surfaces are provided with an electrically insulating coating.

2. A combination according to claim 1, in which the busbar comprises a third branch projecting from said base between, and to a lesser extent than, said outer branches, the sides of said third branch constituting said second contact surfaces.

3. A combination according to claim 1 or 2, in which said thickened edge portions project inwardly from their respective outer branches and form shoulder surfaces for a clamping member belonging to a screw connection coupling device.

4. A combination according to claim 1, in which said at least one coupling device comprises a connection part, one side of which is provided with means for attaching a conductor, and the opposite side of which has slots for attaching a contact element for screw or plug-in connection to the busbar, said connection part being fixed to a base made of electrically insulating material and having a slot for the passage of said conductor.

5. A combination according to claim 4, in which said connection part comprises a centrally arranged contact strip and said contact element for plug-in connection comprise two contact fingers interconnected by a spring, said contact fingers being arranged on opposite sides of said contact strip.

6. A combination according to claim 3, in which said at least one coupling device comprises a connection part, one side of which is provided with means for attaching a conductor, and the opposite side of which has slots for attaching a contact element for screw or plug-in connection to the busbar, said connection part being fixed to a base made of electrically insulating material and having a slot for the passage of said conductor.

7. A combination according to claim 6, in which said connection part and said contact element for screw connection have a through-hole for a clamping screw which has screw-threaded engagement with said clamping member which is insertable into the interior of the busbar, said clamping member, when tightening the screw, being pressed against said shoulder surfaces on the busbar, in order to press two projecting wall portions on said contact element against said first contact surfaces.

8. A combination according to claim 1 or 2, in which said busbar is an extruded profile.

9. A combination according to claim 1 or 2, in which parts of said at least one coupling device are manufactured by extrusion.

10. A combination according to claim 1 or 2, in which said busbar is manufactured of aluminium and copper.

11. A combination according to claim 5, in which said connection part is manufactured of aluminium and copper.

* * * * *